US008272184B2

(12) United States Patent
Cech

(10) Patent No.: US 8,272,184 B2
(45) Date of Patent: Sep. 25, 2012

(54) GRIPS FOR ASSOCIATING CONCRETE REINFORCEMENT BARS

(76) Inventor: Donald E. Cech, Longmont, CO (US)

( * ) Notice: Subject to any disclaimer, the term of this patent is extended or adjusted under 35 U.S.C. 154(b) by 52 days.

(21) Appl. No.: 12/807,317

(22) Filed: Sep. 3, 2010

(65) Prior Publication Data

US 2012/0055113 A1 Mar. 8, 2012

(51) Int. Cl.
*E04C 5/16* (2006.01)

(52) U.S. Cl. ..... 52/677; 52/678; 52/679; 52/681; 52/682

(58) Field of Classification Search ..... 52/677–689
See application file for complete search history.

(56) References Cited

U.S. PATENT DOCUMENTS

| | | | | |
|---|---|---|---|---|
| 3,300,930 | A | 1/1967 | Weise | |
| 3,694,989 | A * | 10/1972 | Oliver et al. | 52/678 |
| 4,610,122 | A | 9/1986 | De Clercq | |
| 4,617,775 | A | 10/1986 | Padrun | |
| 4,835,933 | A | 6/1989 | Yung | |
| 5,127,763 | A | 7/1992 | Kunoki | |
| 5,371,991 | A | 12/1994 | Bechtel et al. | |
| D355,582 | S | 2/1995 | Sleight | |
| 5,699,642 | A | 12/1997 | McDevitt, Jr. | |
| 5,791,816 | A * | 8/1998 | McCallion | 404/136 |
| 5,878,546 | A | 3/1999 | Westover | |
| 5,893,252 | A | 4/1999 | Hardy, Jr. et al. | |
| 6,092,960 | A * | 7/2000 | McCallion | 404/70 |
| 6,112,494 | A | 9/2000 | Hardy, Jr. et al. | |
| D526,188 | S | 8/2006 | Minor et al. | |
| D529,794 | S | 10/2006 | Murray | |
| 7,143,563 | B1 | 12/2006 | Palmer | |
| D534,418 | S | 1/2007 | Minor et al. | |
| 7,241,071 | B2 | 7/2007 | Carraher et al. | |
| 7,461,491 | B1 * | 12/2008 | Sorkin | 52/685 |
| 7,469,515 | B2 | 12/2008 | Minor | |
| 2004/0040247 | A1 | 3/2004 | Morse | |
| 2008/0115449 | A1 | 5/2008 | Kodi | |
| 2010/0307098 | A1 * | 12/2010 | Yee | 52/677 |

* cited by examiner

*Primary Examiner* — Mark Wendell
(74) *Attorney, Agent, or Firm* — Harold A. Burdick

(57) ABSTRACT

Improved grips for retaining plural concrete reinforcing bars in a selected association are disclosed. The grips include a base portion and a retention portion including engageable structures establishing first and second spaced opposing pairs of clamping formations. Each of the plural reinforcing bars in the association is positively gripped along a length thereof between the clamping formations. Grip embodiments for parallel and right angle reinforcing bar associations are disclosed.

20 Claims, 5 Drawing Sheets

GRIPS FOR ASSOCIATING CONCRETE REINFORCEMENT BARS

FIELD OF THE INVENTION

This invention relates to concrete reinforcing bar retainers, and, more particularly, relates to devices used for securing the position of concrete reinforcing bars during concrete structure formation.

BACKGROUND OF THE INVENTION

Concrete reinforcing bar material (rebar) is used in many applications to strengthen concrete structures. Such materials are often positioned in grids or other supporting structures wherein suspension, relative positioning and securement of materials are controlled using wire ties. While in wide usage, these commonly used wire ties are often less than robust, breaking, sliding or stretching out of position when concrete is poured and allowing rebar movement thereby reducing their effectiveness. Improvements to standard wire ties, such as plastic harnessing, have been heretofore suggested and/or utilized but suffer many of the same deficiencies (see U.S. Pat. No. 5,699,642).

A variety of securing structures in the nature of monolithic clips, typically of molded plastic material, have been suggested for adjacently locating rebar materials (see U.S. Patent Application Publication No. US2008/0115449 and U.S. Pat. Nos. 7,469,515, 7,143,563, 5,371,991, 4,617,775, 4,610,122, D534,418, D526,188, D510,857, and Des. 355,582). Many of these devices are open-ended clamping structures that may still allow significant movement of rebar materials placed therein, including total dislodgement therefrom. Many seemingly lack the structural integrity necessary to hold the rebar in place and have no means of locking themselves on the rebar material, often relying solely on the memory of the plastic material to maintain engagement. Moreover, some of these clips require tools to engage the clip with the rebar, requiring careful manufacture of clip tolerances as well as maintenance of additional tools in the field.

A variety of multi-part rebar securing structures such as clips, spacers and retainers have also been heretofore suggested and or utilized (see U.S. Pat. Nos. 7,241,071, 7,143,563, 6,112,494, 5,893,252, 5,878,546, 5,127,763 4,835,933, and 3,300,930). While some improve upon open-ended designs, many still suffer from lack of sufficient clamping force to firmly and securely retain material positioning and inability to accept various sized/shaped materials, are expensive to manufacture and time consuming to install, and utilize unions or other features that may be susceptible to breakage or dislodgement.

Further improvement in the design and utilization of rebar material securing structures could thus still be utilized.

SUMMARY OF THE INVENTION

This invention provides an improved securing structure for associating plural concrete reinforcing bars. A durable, elongated closed loop grip is thus provided that achieves clamping sufficient to significantly restrict movement of reinforcing bars associated at the grip thereby preventing slipping, position change and/or dislodgement during construction and concrete pouring operations. The grip of this invention holds reinforcing bars in place in a selected association by locking themselves on the rebar material, fit achieved largely without concern for size and shape variations of the bars.

No special tools are required to engage the grip of this invention on the reinforcing bars, and manufacturing tolerances are not particularly critical since portions of the grip are variably positionable during application of clamping forces in the field. Similarly, clamping force achieved utilizing the grip of this invention is sufficient to firmly and securely retain material of many different sizes and shapes in selected relative positions. Grips in accord with this invention are resistant to breaking, inexpensive to manufacture, and quick and easy to install.

The grip includes a base portion having plural mating structures spaced thereabout and a retention portion including plural matable structures spaced thereabout each configured to engage a different one of the mating structures of the base portion. The base portion is configured to receive plural concrete reinforcing bars thereat in a selected association (for example, either parallel or at 90° to each other depending on the embodiment of the grip). The mating structures of the base portion each include either multiple graduated engagements or a catch, and the matable structures of the retention portion each include multiple graduated engagements or a catch not found at an opposite one of the mating structures of the base portion.

Each of the plural mating structures of the base portion is variably positionable relative to and lockable with a different one of the plural matable structures of the retention portion. A clamping formation is thus established by selective engagement along the multiple graduated engagements with the catch so that each of the plural reinforcing bars in the association is positively gripped along a length thereof between the clamping formations.

The base portion of the grip preferably includes at least three mating structures in the form of tongues, each tongue structure including the multiple engagements therealong. The retention portion then includes at least three matable structures in the form of openings configured to receive a different one of the tongue structures, the openings each having the catch positioned therein. Each of the tongue structures of the base portion is variably positionable relative to and lockable at one of the openings of the retention portion by selective receipt of the catch in one of the multiple engagements.

The retention portion preferably includes at least a first elongated contoured reinforcing bar receiving structure. The tongue structures of the base portion and openings at the retention portion are best deployed in first and second spaced opposing pairs, thereby providing first and second spaced opposing pairs of clamping formations when engaged with each other so that each of the plural reinforcing bars in the association is positively gripped along a length thereof between the clamping formations.

It is therefore an object of this invention to provide an improved grip for associating concrete reinforcing bars in selected relative positions.

It is another object of this invention to provide a durable, elongated closed loop grip for retaining plural concrete reinforcing bars in a selected association.

It is another object of this invention to provide a grip for retaining plural concrete reinforcing bars in a selected association that achieves clamping sufficient to significantly restrict movement of reinforcing bars associated at the grip thereby preventing slipping, position change and/or dislodgement.

It is still another object of this invention to provide grips for retaining plural concrete reinforcing bars in either right angle or parallel orientations.

It is yet another object of this invention to provide a grip for retaining plural concrete reinforcing bars in a selected association with the structural integrity necessary for holding reinforcing bars in place and locking themselves on the material without concern for size and shape variations of the bars.

It is another object of this invention to provide a grip for retaining plural concrete reinforcing bars in a selected association that reduces the time spent associating reinforcing bars in a grid and prevents grid movement during installation and concrete pouring.

It is still another object of this invention to provide a grip for retaining plural concrete reinforcing bars in a selected association wherein no special tools are required to engage the grip on the reinforcing bars, and wherein manufacturing tolerances are not particularly critical.

It is yet another object of this invention to provide grips for retaining plural concrete reinforcing bars in a selected association that are inexpensive to manufacture and are quick and easy to install.

It is still another object of this invention to provide a grip for retaining plural concrete reinforcing bars in a selected association that includes a base portion with plural mating structures spaced thereabout and configured to receive the plural concrete reinforcing bars thereat in a selected association, the mating structures each including either multiple graduated engagements or a catch, and a retention portion including plural matable structures spaced thereabout each configured to engage a different one of the mating structures of the base portion, the matable structures each including one of multiple graduated engagements and a catch not found at an opposite one of the mating structures of the base portion, each of the plural mating structures of the base portion variably positionable relative to and lockable with a different one of the plural matable structures of the retention portion to establish a clamping formation by selective engagement along the multiple graduated engagements with the catch so that each of the plural reinforcing bars in the association is positively gripped along a length thereof between the clamping formations.

It is still another object of this invention to provide a grip for retaining plural concrete reinforcing bars in a selected association that includes a base portion configured to receive the plural concrete reinforcing bars thereat in a selected association and including at least three tongue structures spaced thereabout each including multiple engagements therealong, and a retention portion including at least three openings spaced thereabout each configured to receive a different one of the tongue structures of the base portion, the openings each having a catch positioned therein, whereby each of the tongue structures of the base portion is variably positionable relative to and lockable at one of the openings of the retention portion by selective receipt in one of the multiple engagements of the catch.

It is yet another object of this invention to provide a grip for retaining plural concrete reinforcing bars in a selected association that includes a base portion configured to receive the plural concrete reinforcing bars thereat in a selected association and including first and second spaced opposing pairs of tongue structures, and a retention portion including at least a first elongated contoured reinforcing bar receiving structure and first and second spaced opposing pairs of openings, each of the openings configured to receive a different one of the tongue structures of the base portion, the openings each having a catch positioned therein, the tongue structures of the base portion variably positionable relative to and lockable at the openings of the retention portion by selective engagement of the catches along the tongue structures to establish a first and second spaced opposing pairs of clamping formations so that each of the plural reinforcing bars in the association is positively gripped along a length thereof between the clamping formations.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
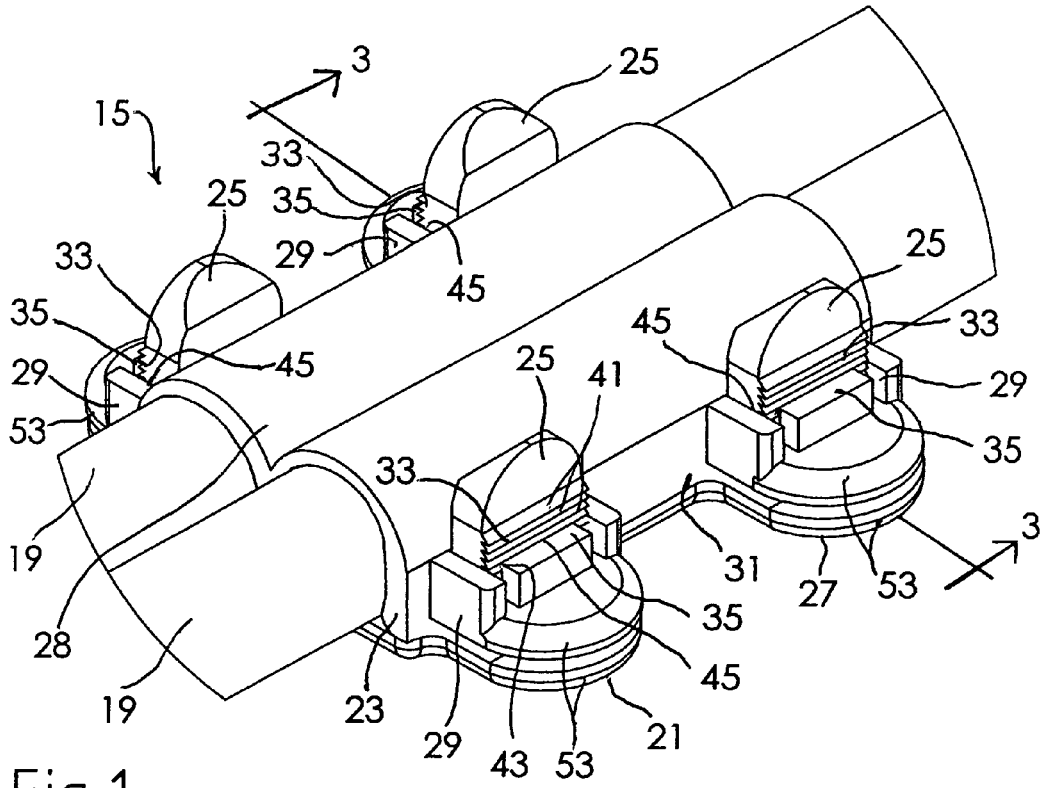
FIG. 1 is a perspective view of a first embodiment of the grip for associating concrete reinforcing bars of this invention for parallel association.
Figure 2:
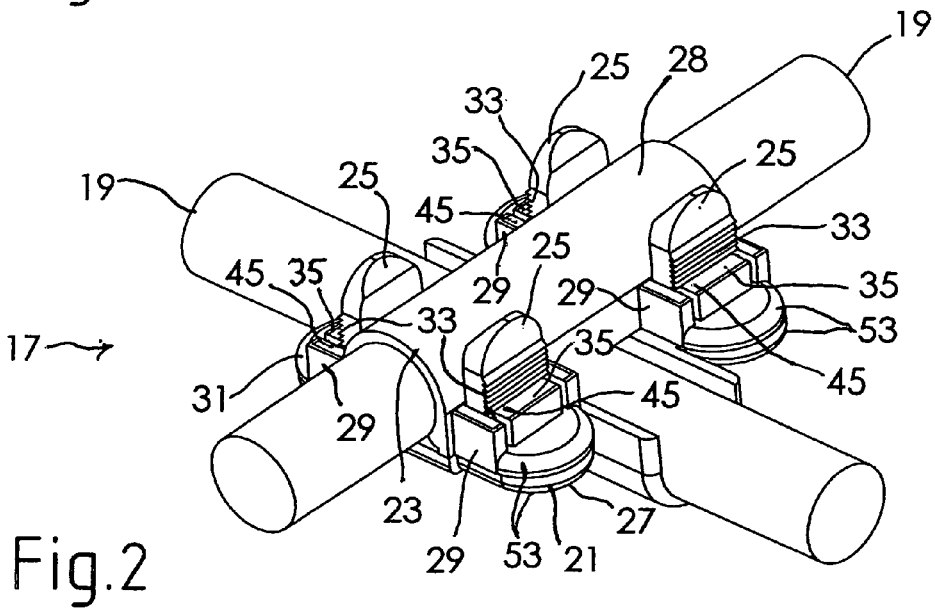
FIG. 2 is a perspective view of a second embodiment of the grip for associating concrete reinforcing bars of this invention for perpendicular association.

First and second preferred embodiments 15 and 17 of the grips for associating concrete reinforcing bars of this invention are illustrated in FIGS. 1 and 2, respectively. Grip 15 is configured for securing reinforcing bars 19 in a substantially aligned association (parallel, for example; see also FIGS. 3 through 6), while grip 17 is configured for securing reinforcing bars 19 in a crossing configuration (at 90°, for example; see also FIGS. 7 through 10). In both embodiments, the grip for retaining plural concrete reinforcing bars 19 of this invention includes base portion 21 and retention portion 23. Hereinafter base portion 21 and retention portion 23 will be consistently identified as such, but for most purposes the identification as "base" or "retention" is largely arbitrary and could be applied to either of portions 21 or 23.

Base portion 21 includes plural mating structures 25 spaced thereabout adjacent to the outer periphery 27 of base portion 21, each mating structure preferably configured as a biasable tongue. Plural concrete reinforcing bars 19 are thus receivable thereat in a selected association as illustrated in the FIGURES. Retention portion 23 includes at least a first elongated contoured reinforcing bar receiving structure 28 providing a clip structure for receipt therein of a reinforcing bar 19. Plural matable structures 29 are spaced thereabout adjacent to outer periphery 31 of retention portion 23. Matable structures 29 are preferably configured as channelized openings to engage a different mating structure 25 of base portion 21.

Mating structures 25 and matable structures 29 are configured for locking engagement with each including one of multiple graduated engagements or a catch. These structures are preferably provided with engagements 33 at tongue structures 25 and catches 35 forming one part of channel 37 defining the openings 39 of structures 29 (see also FIGS. 5, 6, 8 and 10). However, these structures could be oppositely positioned with the tongue structures and engagements 33 located at retention portion 23 and the openings and catches 35 located at base portion 21. Moreover some of engagements 33 and some of catches 35 could both be located at the base portion, with some engagements and some catches located oppositely at the retention portion.

Figure 3:
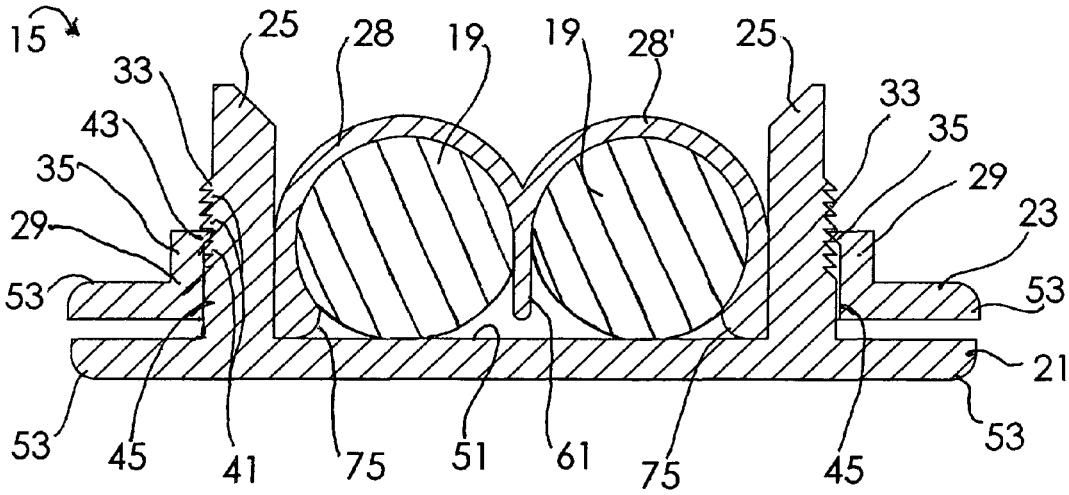
FIG. 3 is a sectional view taken along lines 3-3 of FIG. 1.
Figure 4:
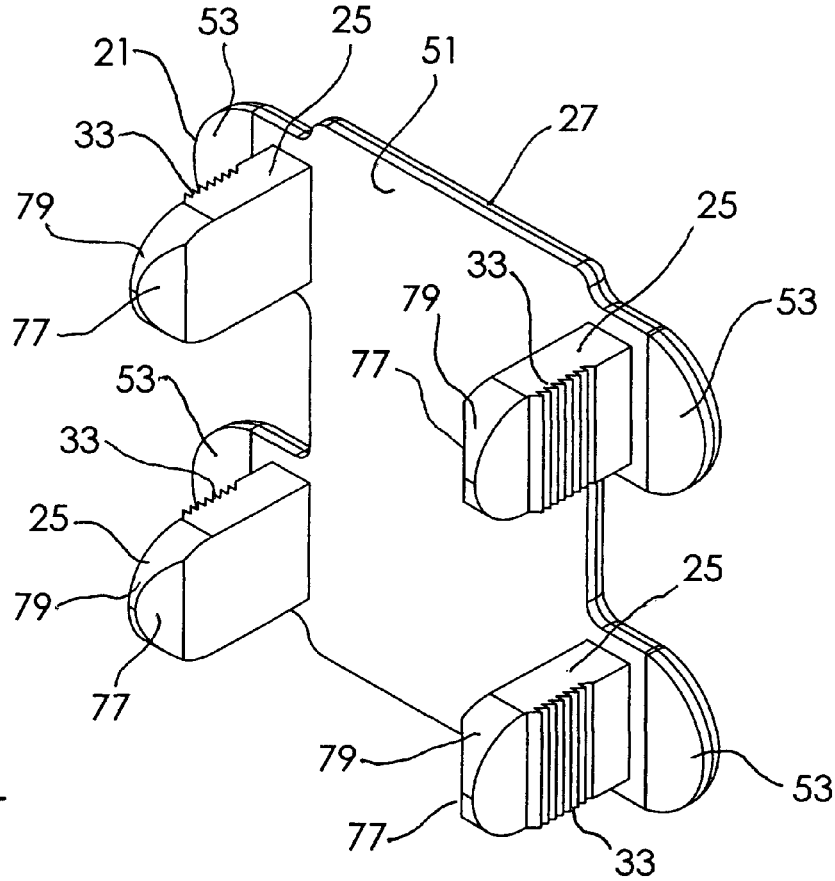
FIG. 4 is a perspective view of the base portion of the grip embodiment of FIG. 1.
Figure 5:
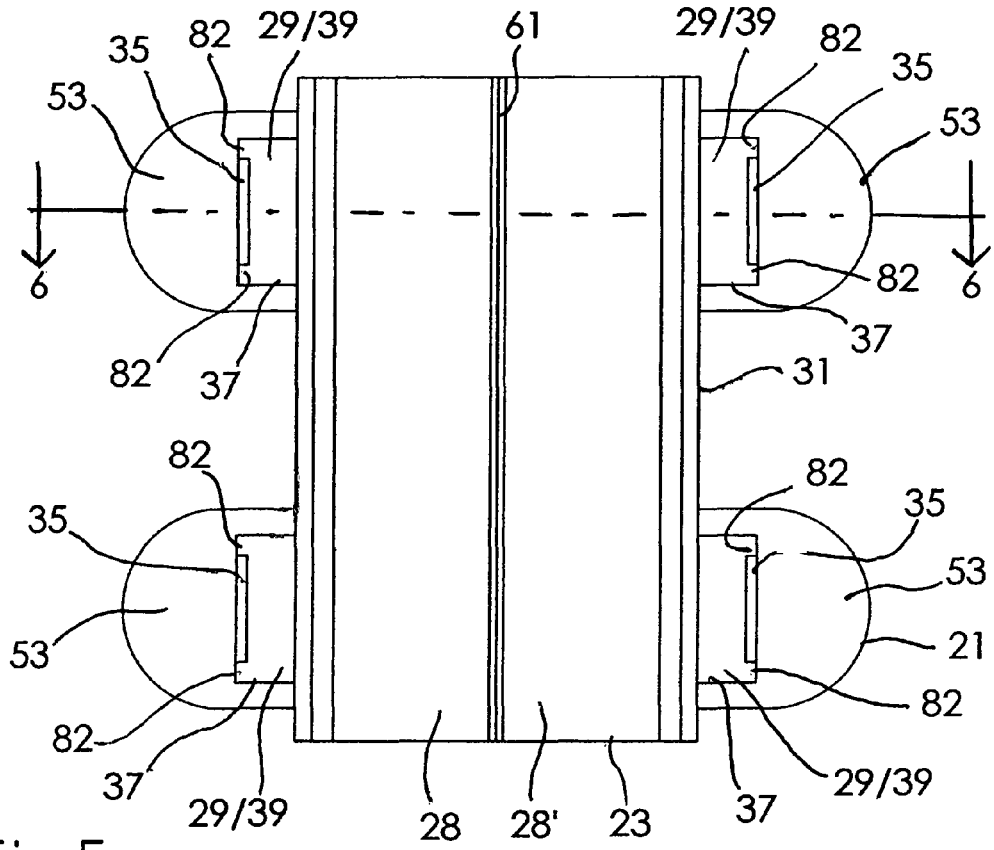
FIG. 5 is a bottom view of the upper portion of the grip embodiment of FIG. 1.
Figure 6:
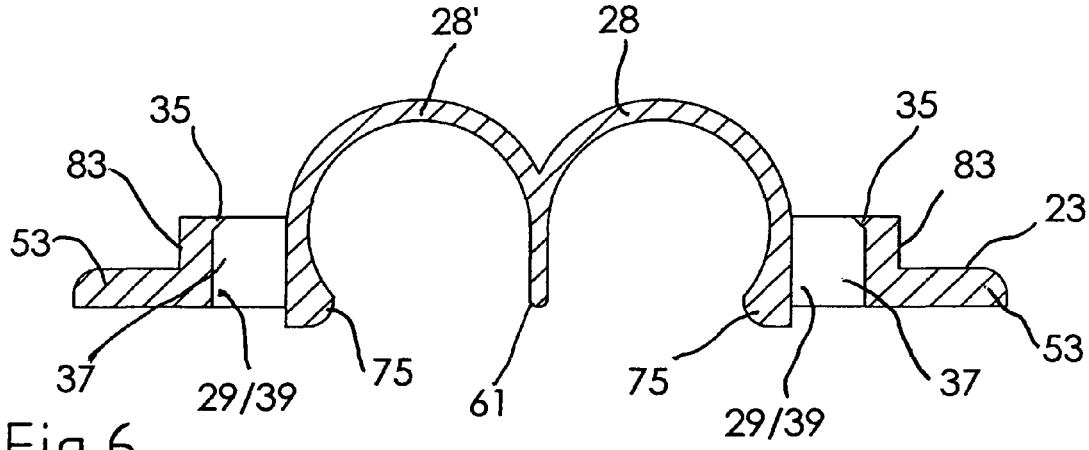
FIG. 6 is a sectional view taken through section lines 6-6 of FIG. 5.
Figure 7:
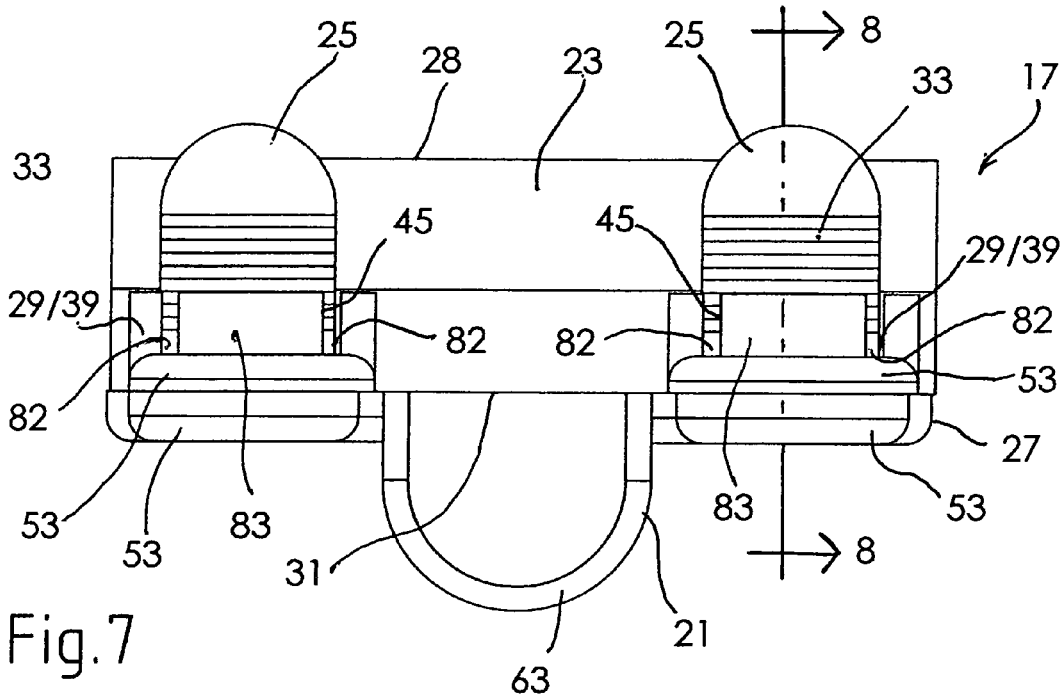
FIG. 7 is a side view of the grip embodiment of FIG. 2.
Figure 8:
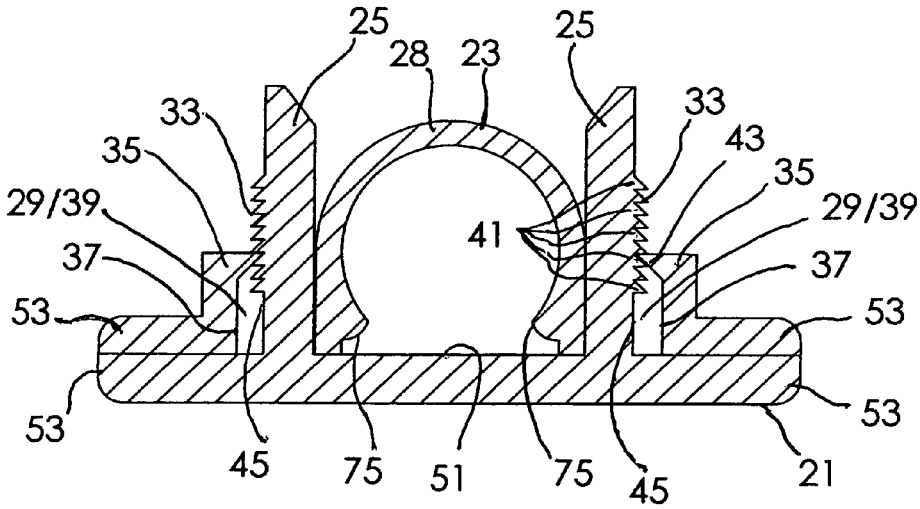
FIG. 8 is a sectional view taken through section lines 8-8 of FIG. 7.
Figure 9:
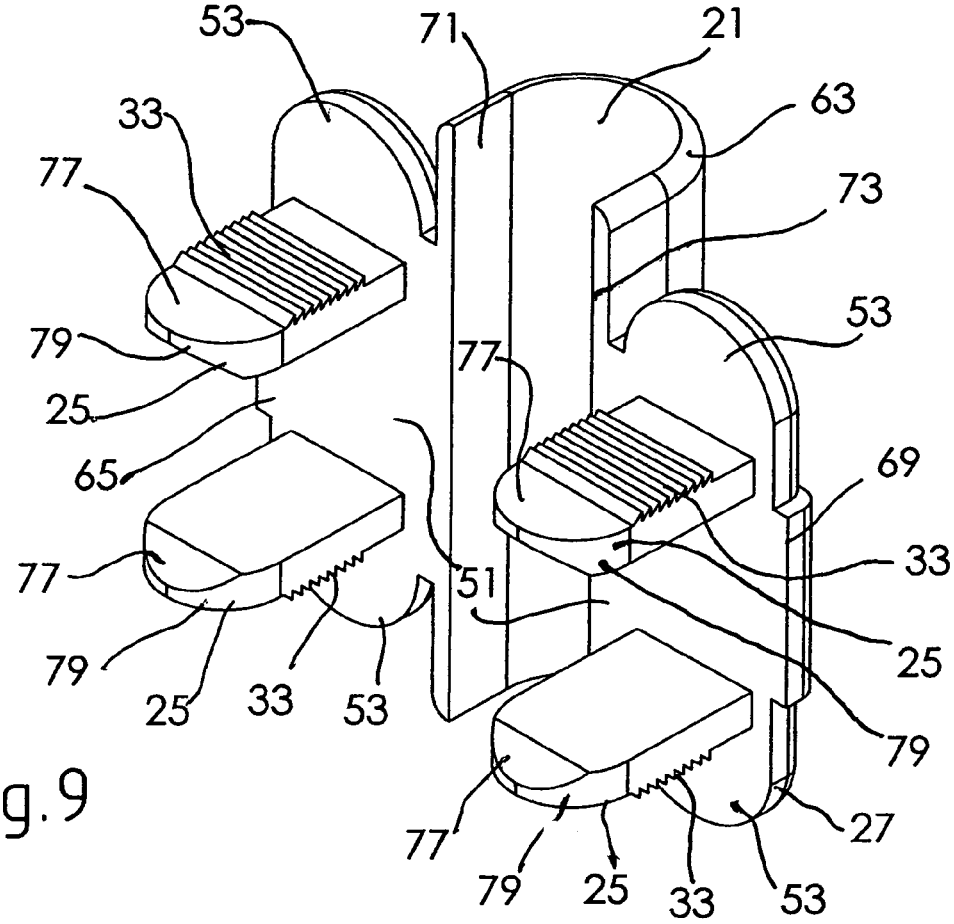
FIG. 9 is a perspective view of the base portion of the grip embodiment of FIG. 2.
Figure 10:
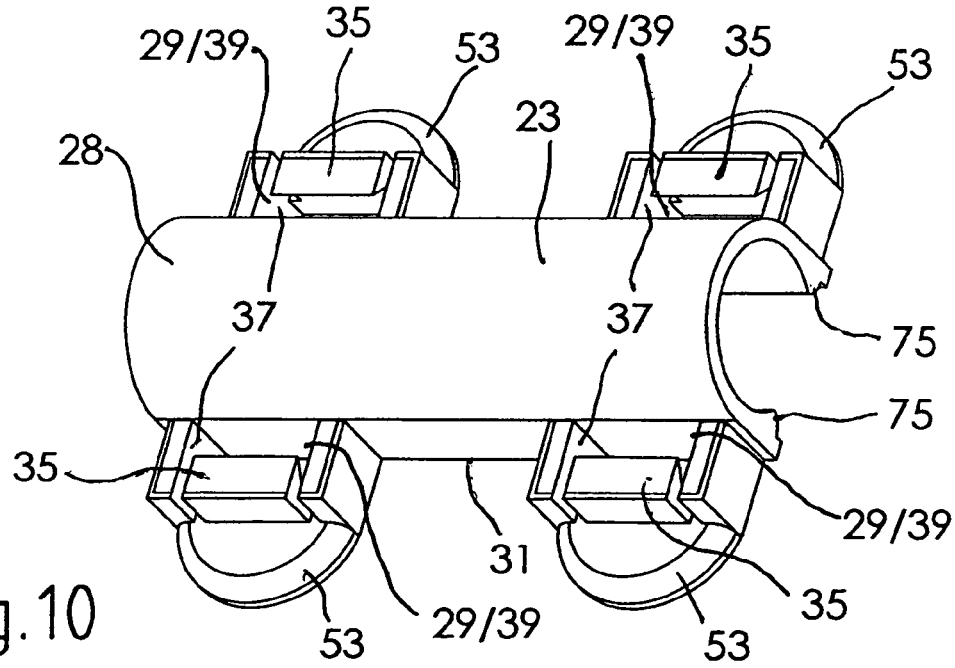
FIG. 10 is a perspective view of the upper portion of the grip embodiment of FIG. 2.

Engagements 33 are preferably configured as a plurality of wedge-shaped striations 41 while catch 35 preferably includes a wedge shaped projection 43 (see also FIGS. 3 and 8). The graduated arrangements at engagements 33 and the particular angular orientations of the wedge shapes as illustrated in the FIGURES allow for each of plural mating structures 25 of base portion 21 to be variably positionable relative to and lockable with a different one of the plural matable structures 29 of retention portion 23 to establish adaptable clamping formations 45 when the grip is installed.

The angular orientations of striations 41 and projections 43 are established to permit movement of tongue structures 25 past catches 35 in one direction and restrict movement of the tongue structures thereby in an opposite direction to thus irreversibly lock clamping formations 45. Providing this mechanism for selective engagement of catches 35 along the multiple graduated engagements 33 allows variable positioning of structures 25 and 29 in a clamping formation 45 to accommodate material size and shape variations, each of the plural reinforcing bars in the association thereby being positively gripped along a length thereof between clamping formations 45 without regard to such variations.

While the embodiments of FIGS. 1 and 2 are illustrated with four tongue structures 25 located in spaced opposing pairs at base portion 21 for receipt in four opposite opening structures 29 organized in spaced opposing pairs at retention portion 23, more or fewer such structures could be utilized. Mating tongue structures 25 are preferably formed so that the appendage is resiliently biasable to allow passage smoothly into opening structures 29/39 while gripping retention portion 23 therebetween. Each mating tongue structure 25 extends from planar surface 51 of base portion 21 (see FIGS. 3, 4, 8 and 9), and structures 25 and matable opening structures 29 each include tabs 53 adjacent thereto at outer peripheries 27 and 31 of base portion 21 and retention portion 23, respectively. Tabs 53 provide means for a user to easily manipulate the portions 21 and 23 of the grip of this invention in the field to form clamping formations 45.

Turning to FIGS. 3 through 6, embodiment 15 of the grip of this invention is shown in greater detail, identifying numerals common to both embodiments 15 and 17 as set forth hereinabove being retained. Planar surface 51 of base portion 21 of embodiment 15 is a continuous surface between tongue structures 25 to accommodate receipt of first and second reinforcing bars 19 therebetween in parallel alignment. Retention portion 23 of embodiment 15 includes first and second parallel elongated contoured structures 28 and 28' between opening structures 29/39 for receiving the first and second reinforcing bars therein. First and second elongated contoured structures 28/28' together define an elongated dividing wall (and, thus, rebar material spacer) 61 therebetween.

The positive grips thus formed at the interior of contoured receiving structures 28/28' are defined by an internal radius of a diameter selected to wrap around the bars 19 and create compression against the bars to hold the grip in place. Spacer wall 61 tensions the outside diameter of structures 28/28' enabling them to positively grip the bars.

FIGS. 7 through 10 illustrate in greater detail embodiment 17 of the grip of this invention identifying numerals common to both embodiments 15 and 17 again being retained. Base portion 21 of embodiment 17 includes elongated contoured reinforcing bar receiving structure 63, a clip between mating structures 25 configured to receive a reinforcing bar 19. Planar surface 51 is defined at each side of contoured receiving structure 63 and between tongue structures 25 to accommodate receipt of a second reinforcing bar 19 in a crossing association with the bar received in receiving structure 63. This second bar 19 is also receivable in elongated contoured reinforcing bar receiving structure 28 of retention portion 23 of embodiment 17 as shown in FIG. 2. Planar surface 51 is defined by first and second flanges 65 and 69 extending from opposite elongated sides 71 and 73, respectively, of contoured reinforcing bar receiving structure 63. Each flange 65 and 69 has at least one (preferably two, as shown) tongue structure 25 projecting therefrom (see FIG. 9).

The positive grips thus formed at the interior of contoured receiving structures 28 and 63 of grip embodiment 17 are defined by an internal radius of a diameter selected to wrap around the bars 19 and create compression against the bars to hold the grip portions 23 and 21, respectively, in place.

In both embodiments 15 and 17, radii 75 allow the grips of this invention to easily slip over a reinforcing bar 19 to be secured during instillation (see FIGS. 3, 6, 8 and 10). Bevels 77 and radii 79 help an installer to lead and locate mating structures 25 into engagement at matable opening structures 29/39 (see FIGS. 4 and 9). Slots 82 permit flexion of catch legs 83 facilitating passage of engagements 33 by catches 35 and engagement and locking of structures 25 and 29. Wall thickness of leg 83 is selected to generate sufficient force desired to hold caches 35 locked in place.

As may be appreciated, grips for holding two reinforcing bars in association with each other, whether the bars are of the same or different diameters and irrespective of material deficiencies in shape or size, are provided herein. Embodiments for parallel and crossing associations are shown for formation of reinforcing bar grids to reinforce poured concrete. The grips are preferably made of commonly used engineering plastics and/or thermoplastic polyurethanes (such as M90 acetal copolymer by CELCON) and may include 10% to 20% recycled material. In general, the chosen plastic should exhibit good dimensional stability and toughness. For example, material with glass transition temperature around −55° F., Vicat softening point around 325° F., and melting point around 330° F. are preferable. Such materials are preferred that exhibit a tensile modulus around 410,000 psi, a tensile strength at yield of around 8,800 psi, a flexural modulus around 375,000 psi, flexural strength at break of about 13,000 psi, compressive strength of about 16,000 psi, shear strength around 7,700 psi, a self friction coefficient of around 0.35, a fatigue limit of around 3,300 psi, unnotched Izod impact (High) around 20 ft-lb/in., tensile impact strength around 70 ft-lb/in.$^2$, and Rockwell hardness M of about 80. These grips may be used wherever wire ties have heretofore been used for association of reinforcing bars, and provide improved grid securement limiting vertical, horizontal and lateral bar movement, slipping and/or dislodgement. The grips are preferably particularized as to grip portion sizes for each rebar size category, but may be engineered to fit a selected range of rebar size categories. Grip portions 21 and 23, each adapted for different sizes of rebar, may be combined and all portion sizes are readily interchangeable to match rebar size associations as required in the field.

What is claimed is:

1. A grip for retaining plural concrete reinforcing bars in a selected association comprising:

a base portion including plural mating structures spaced thereabout and configured to receive the plural concrete reinforcing bars thereat in a selected association, said mating structures each including either multiple graduated engagements or a catch; and a retention portion including plural matable structures spaced thereabout each configured to engage a different one of said mating structures of said base portion, said matable structures each including one of multiple graduated engagements and a catch not found at an opposite one of said mating structures of said base portion, said retention portion having at least a first contoured reinforcing bar receiving structure positioned among said matable structures, said contoured reinforcing bar receiving structure having an internal radius selected to wrap around one of the bars received therein and create selected compression around the bar so that said retention portion grips the bar;

each of said plural mating structures of said base portion variably positionable relative to and lockable with a different one of said plural matable structures of said retention portion to establish a clamping formation by selective engagement along said multiple graduated engagements with said catch so that each of the plural reinforcing bars in the association is positively gripped along a length thereof between said clamping formations.

2. The grip of claim 1 wherein at least one of said base portion and said retention portion includes a second contoured reinforcing bar receiving structure configured to receive another one of the reinforcing bars.

3. The grip of claim 1 wherein said mating structures of said base portion each include a biasable appendage extending from a planar surface of said base portion, and wherein said matable structures of said retention portion each include a channel for receiving said biasable appendage.

4. The grip of claim 3 wherein said catches are positioned at said channels of said matable structures and wherein said graduated engagements are located along said biasable appendages of said mating structures.

5. The grip of claim 4 wherein each of said catches include a projection extending into said channel, said projections configured to permit movement of said graduated engagements of said appendages thereby in one direction and restrict movement of said graduated engagements of said appendages thereby in an opposite direction to thus lock said clamping formations.

6. The grip of claim 1 wherein said base portion includes at least one of a planar surface and a contoured surface between said mating structures to accommodate receipt of the reinforcing bars thereat.

7. A grip for retaining plural concrete reinforcing bars in a selected association comprising:

a base portion including plural mating structures spaced thereabout and configured to receive the plural concrete reinforcing bars thereat in a selected association, said plural mating structures comprising at least three spaced tongue structures each including multiple graduated engagements therealong; and a retention portion including plural matable structures spaced thereabout each configured to engage a different one of said mating structures of said base portion, said plural matable structures comprising at least three spaced openings each configured to receive a different one of said tongue structures of said base portion, said openings each having a catch positioned therein, whereby each of said tongue structures of said plural mating structures of said base portion is variably positionable relative to and lockable with a different one of said openings of said plural matable structures of said retention portion to establish a clamping formation by selective receipt of said catch in one of said multiple engagements so that each of the plural reinforcing bars in the association is positively gripped along a length thereof between said clamping formations.

8. The grip of claim 7 wherein said base portion includes a planar surface between said tongue structures to accommodate receipt of first and second reinforcing bars in parallel alignment thereat.

9. The grip of claim 8 wherein said retention portion includes first and second parallel elongated contoured structures between said openings for receiving the first and second reinforcing bars, respectively, therein.

10. The grip of claim 9 wherein said first and second elongated contoured structures are together configured to define an elongated dividing wall therebetween.

11. The grip of claim 7 wherein each of said tongue structures at said base portion include a tab adjacent thereto defined at an outer periphery of said base portion and wherein each of said openings at said retention portion include a tab adjacent thereto defined at an outer periphery of said retention portion.

12. The grip of claim 7 wherein said base portion includes an elongated contoured reinforcing bar receiving structure between said tongue structures and a planar surface at each side of said contoured structure between said tongue structures to accommodate receipt of first and second reinforcing bars at said contoured structure and said planar surface, respectively, in a crossing association.

13. The grip of claim of 12 wherein said planar surface of said base portion is defined by first and second flanges extending from opposite elongated sides of said contoured reinforcing bar receiving structure and each having at least one of said tongue structures projecting therefrom.

14. The grip of claim 12 wherein said retention portion includes a first elongated contoured reinforcing bar receiving structure between said openings to accommodate receipt of the second reinforcing bar therein.

15. The grip of claim of 14 wherein said retention portion has a plurality of channels at an outer periphery thereof, each of said channels defined in part by one of said catches and having one of said openings therethrough.

16. A grip for retaining plural concrete reinforcing bars in a selected association comprising:

a base portion including plural mating structures spaced thereabout and configured to receive the plural concrete reinforcing bars thereat in a selected association, said plural mating structures comprising first and second spaced opposing pairs of tongue structures each of said tongue structures including graduated engagements; and a retention portion including plural matable structures spaced thereabout each configured to engage a different one of said mating structures of said base portion, said plural matable structures comprising first and second spaced opposing pairs of openings, each of said openings configured to receive a different one of said tongue structures of said base portion, said openings each having a catch positioned therein, said retention portion further including at least a first elongated contoured reinforcing bar receiving structure, whereby each of said tongue structures of said plural mating structures of said base portion are variably positionable relative to and lockable at a different one of said openings of said plural matable structures of said retention portion to establish a clamping formation by selective engagement of said catches along said graduated engagements of said tongue structures to establish first and second spaced opposing pairs of said clamping formation so that each of the plural reinforcing bars in the association is positively gripped along a length thereof between said pairs of said clamping formation.

17. The grip of claim 16 wherein said retention portion includes a second elongated contoured reinforcing bar receiving structure parallel to said first receiving structure.

18. The grip of claim 16 wherein said base portion includes an elongated contoured reinforcing bar receiving structure extending between said first and second pairs of tongue structures.

19. The grip of claim 16 wherein said catches of said matable structures each include a projection extending into said opening, said projections configured to permit movement of said tongue structures of said base portion thereby in one direction and restrict movement of said tongue structures thereby in an opposite direction to thus lock said pairs of said clamping formation.

20. The grip of claim 16 wherein said base portion and said retention portion are each molded of plastic material.

* * * * *